US005705774A

United States Patent [19]

Beauchamp

[11] Patent Number: 5,705,774

[45] **Date of Patent: *Jan. 6, 1998**

[54] FLAME RESISTANT ELECTRIC CABLE

[75] Inventor: Mark Beauchamp, St. Hubert, Canada

[73] Assignee: Harbour Industries (Canada) Ltd., Quebec, Canada

[ * ] Notice: The term of this patent shall not extend beyond the expiration date of Pat. No. 5,227,586.

[21] Appl. No.: 568,684

[22] Filed: Dec. 7, 1995

[51] Int. Cl.[6] ..... H01B 7/34

[52] U.S. Cl. ..... 174/121 R; 174/121 A

[58] Field of Search ..... 174/36, 107, 102 R, 174/121 A, 121 R, 120 AR, 121 AR

[56] References Cited

U.S. PATENT DOCUMENTS 2,047,152 7/1936 Mitchell ..... 173/81

4,533,784 8/1985 Olyphant, Jr. ..... 174/36

5,220,130 6/1993 Walters ..... 174/36

5,227,586 7/1993 Beauchamp ..... 174/122 R

*Primary Examiner*—Kristine Kincaid

*Assistant Examiner*—Chau N. Nguyen

*Attorney, Agent, or Firm*—Longacre & White

[57] ABSTRACT

The disclosure herein describes a flame resistant electric cable which is capable of resisting flame temperatures in the neighborhood of 1000° C. for at least two hours; the cable includes at least two electrical conductors each including an electrical wire, an extruded tubular member made of silicone surrounding the electrical wire, and an outer protective layer of braided inorganic material which surrounds the tubular member; the cable includes, underneath an overall outer braided jacket, an extruded elongate tubular member made of a silicone elastomer having a wall thickness of at least 0.030 of an inch.

6 Claims, 1 Drawing Sheet

FLAME RESISTANT ELECTRIC CABLE

FIELD OF THE INVENTION

The present invention relates to an electric cable which is capable of resisting flame temperatures.

BACKGROUND OF THE INVENTION

The demand for electric cables which are capable of maintaining operation during a fire in order to limit fire propagation in buildings is increasing. Government regulations in various countries now specify that essential electrical circuits be protected in order to ensure that the electrical system be capable of operating during a fire to ensure the safety of persons inside the building and also to permit the firemen to be more efficient in controlling and extinguishing fires.

In certain locations, such as in high buildings, a minimum amount of time is needed so that all persons be alerted. Therefore, the electrical system during a fire must be able to be maintained at least during that required time.

It has been established that some essential electrical circuits must be capable of operating for at least two hours, and in some other cases four hours, in order to ensure the safety of people. Such systems include, for example, alarm systems which are essential in order to enable other systems to be operated, such as telephone systems, lighting systems, elevator systems, ventilation systems, fire pumps, etc.

Many cables, presently in use, are capable of resisting temperatures in the neighbourhood of 1000° C. However, their resistance is limited to a period of 30 minutes. One cable, which is presently used and known under the trademark Pyrotenax, is formed of a copper tube with a silica powder capable of resisting to higher temperatures. However, the rigid copper tube prevents the cable from being easily flexed thereby rendering it difficult to install in various sharp bends or corners, or similar areas.

In applicant's U.S. Pat. No. 5,227,586 issued Jul. 13, 1993, there is described a flame resistant electric cable which is capable of resisting flame temperatures in the neighborhood of 1000° C. for at least two hours; the cable comprises an electrical conductor that includes an electrical wire, an extruded tubular member made of silicone surrounding the electrical wire and an outer protective layer of braided inorganic material which surrounds the tubular member. An overall outer braided jacket surrounds the electrical conductor. It has been found that this type of cables requires additional structure to hold the conductors together and to provide mechanical protection.

OBJECTS AND STATEMENT OF THE INVENTION

An object of the present invention is to provide a flame resistant electric cable which is capable of resisting flame temperatures in the neighbourhood of 1000° C. for at least two hours, thus overcoming the problems of some of the cables described above, and furthermore which is capable of resisting flame temperatures during a given period of time. However, this cable must still be flexible for easy installation and strong to provide mechanical protection while securing the electrical conductors together.

This is achieved by providing a flame resisting electric cable which comprises: at least two electrical conductors, each consisting of an electrical wire, of an extruded tubular member made of a silicone elastomer surrounding the electrical wire, and of an outer protective layer of braided inorganic material surrounding the tubular member. An extruded elongate tubular member made of a silicone elastomer surrounds the electrical conductors and has a wall thickness of at least 0.030 inch. An overall outer braided jacket surrounds this tubular member.

The present invention also relates to a flame resistant cable which comprises: at least two electrical conductors each conductor consisting of an electrical wire, of an extruded tubular member made of silicone elastomer that surrounds the electrical wire and of an outer protective layer of braided inorganic material that surrounds the tubular member; a ground wire; an aluminum polyethylene teraphtalate shield enclosing the electrical conductors and the ground wire; an extruded elongate tubular member made of silicone elastomer that surrounds the shield, the elongate tubular member having a thickness of at least 0.030 of an inch; and an overall outer braided jacket that surrounds the elongate tubular member.

In one preferred form of the invention, the inorganic material is silica.

In an other embodiment of the invention, the inorganic material is ceramic.

Other objects and further scope of applicability of the present invention will become apparent from the detailed description given hereinafter. It should be understood, however, that this detailed description, while indicating preferred embodiments of the invention, is given by way of illustration only, since various changes and modifications within the spirit and scope of the invention will become apparent to those skilled in the art.

DESCRIPTION OF PREFERRED EMBODIMENT

Figure 1:
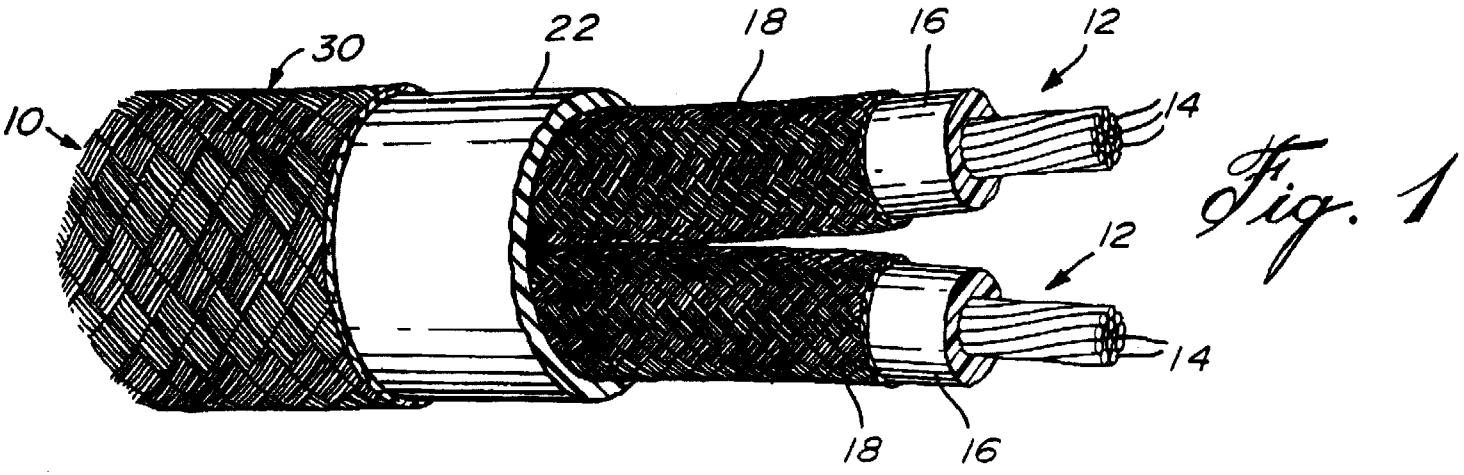
FIG. 1 is a fragmented perspective view of an electrical cable made in accordance with the present invention.

In the embodiment illustrated in FIG. 1, there is shown an electrical cable, generally denoted 10, having a pair of identically constructed conductors 12. Forming each conductor is a plurality of electrical conducting wires 14 which are tightly held in a tubular member 16 which is formed of a heat insulating material, such as silicone rubber. The tubular member 16 is helically wrapped with an outer layer of braided inorganic material 18; this inorganic material is either silica or ceramic. The two electrical conductors 12 are contained within an elongate tubular member 22 having a given thickness as defined hereinbelow. This member 22 may be made of a material similar to that of member 16 of the electrical conductor, i.e. silicone rubber. Member 22 serves to hold the electrical conductors together and to provide mechanical protection to the cable. An overall outer braided jacket 30, made of fiberglass material, surrounds the double layer of ceramic material and provides additional mechanical protection to the cable.

Figure 2:
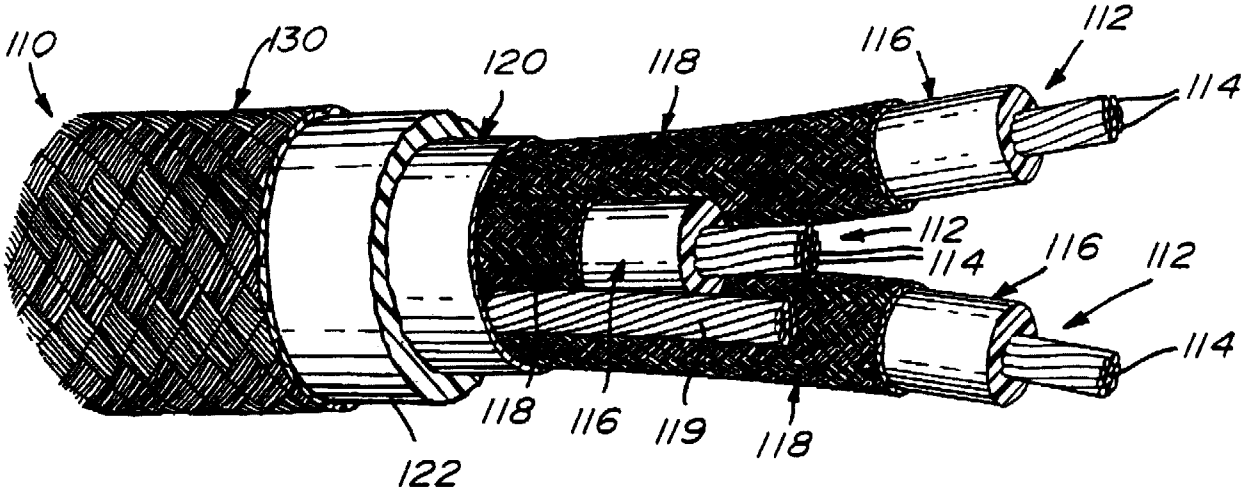
FIG. 2 is a fragmented perspective view of an other embodiment of an electrical cable made in accordance with the present invention.

In the embodiment illustrated in FIG. 2, there is shown a cable 110 which is formed of three identically constructed conductors 112 each having components 114, 116 and 118, identical to that of the conductors 12 in FIG. 1. The three conductors together with a ground wire 119 are enclosed within a tubular member 120, which may be a thin aluminum/Mylar® (polyethylene teraphtalate) shield. An elongate tubular member 122 having a wall thickness as defined hereinbelow surrounds the shield to hold the conductors together and to provide mechanical protection. The tubular member is surrounded by an outer braided jacket 130 of fibreglass material. The shield 120 provides an electrical barrier to the cable while the jacket 130 provides additional mechanical protection thereto.

It has been found that the wall thickness of the elongate tubular member 22 (FIG. 1) or 122 (FIG. 2) described above should have a minimum value of 0.030" for a cable wherein the overall diameter under the member is 0.200". For cables having an overall diameter under the member between 0.201" and 0.300", the thickness is 0.040"; between 0.301" and 0.501", the thickness is 0.050"; between 0.501" and 0.750", the thickness is 0.060" and between 0.751" and 1.100", the thickness is 0.070".

The combination of the various materials forming the components shown in FIGS. 1 and 2 provide the flexibility required to facilitate cable installation or transport.

Although the invention has been described above in relation to two specific forms, it will be evident to the person skilled in the art that it may be refined and modified in various ways. For example, although the drawings show cables having two and three electrical conductors, cables having more or less conductors may also be used. Furthermore, although silicone rubber is indicated as a preferred material for the elongate tubular members, a thermo-plastic elastomer could be used; however, such material would provide more smoke, when burning, than would silicone rubber. It is therefore wished to have it understood that the present invention should not be limited in interpretation except by the terms of the following claims.

The embodiments of the invention in which an exclusive property or privilege is claimed are defined as follows:

1. A flame resistant electric cable capable of resisting flame temperatures in the neighborhood of 1000° C. for at least two hours comprising: at least two electrical conductors, each consisting of an electrical wire, of an extruded tubular member made of a silicone elastomer surrounding said electrical wire, and of an outer protective layer of braided inorganic material surrounding said tubular member; an extruded elongate tubular member made of a silicone elastomer surrounding said electrical conductors, said extruded elongate tubular member having a wall thickness of at least 0.030 inch; and an overall outer braided jacket surrounding said elongate tubular member.

2. A flame resistant electric cable capable of resisting flame temperatures in the neighborhood of 1000° C. for at least two hours comprising: at least two electrical conductors, each conductor consisting of an electrical wire, of an extruded tubular member made of silicone elastomer surrounding said electrical wire and of an outer protective layer of braided inorganic material surrounding said tubular member; a ground wire; an aluminum/polyethylene terephtalate shield enclosing said electrical conductors and said ground wire; an extruded elongate tubular member made of silicone elastomer surrounding said shield, said elongate tubular member having a thickness of at least 0.030 of an inch; and an overall outer braided jacket surrounding said elongate tubular member.

3. A flame resistant electric cable as defined in claim 1, wherein said inorganic material is silica.

4. A flame resistant electric cable as defined in claim 1, wherein said inorganic material is ceramic.

5. A flame resistant electric cable as defined in claim 2, wherein said inorganic material is silica.

6. A flame resistant electric cable as defined in claim 2, wherein said inorganic material is ceramic.

* * * * *